US010689846B2

(12) United States Patent
Ullett et al.

(10) Patent No.: US 10,689,846 B2
(45) Date of Patent: Jun. 23, 2020

(54) SHAFTWALL SYSTEM USING FOLDED PANELS, AND PANEL

(71) Applicant: UNITED STATES GYPSUM COMPANY, Chicago, IL (US)

(72) Inventors: James M. Ullett, McHenry, IL (US); Naveen Punati, Arlington Heights, IL (US)

(73) Assignee: UNITED STATES GYPSUM COMPANY, Chicago, IL (US)

( * ) Notice: Subject to any disclaimer, the term of this patent is extended or adjusted under 35 U.S.C. 154(b) by 0 days.

(21) Appl. No.: 15/653,283

(22) Filed: Jul. 18, 2017

(65) Prior Publication Data

US 2018/0073246 A1 Mar. 15, 2018

Related U.S. Application Data

(60) Provisional application No. 62/385,613, filed on Sep. 9, 2016.

(51) Int. Cl.
*E04B 2/78* (2006.01)
*E04F 17/00* (2006.01)
(Continued)

(52) U.S. Cl.
CPC ..... *E04B 2/7854* (2013.01); *E04B 1/943* (2013.01); *E04B 2/7411* (2013.01); *E04B 2/789* (2013.01); *E04B 2/7872* (2013.01); *E04F 17/005* (2013.01)

(58) Field of Classification Search
USPC ..... 52/30, 631, 796.1, 796.11, 796.12
See application file for complete search history.

(56) References Cited

U.S. PATENT DOCUMENTS 1,671,084 A * 5/1928 Meyercord ..... A47B 96/202 52/631
1,734,209 A * 11/1929 Huffine ..... F16L 59/022 138/149

(Continued)

FOREIGN PATENT DOCUMENTS

DE 10246413 A1 4/2004
WO 96/21779 A1 7/1996

OTHER PUBLICATIONS

International Search Report from International Patent Application No. PCT/US2017/050576, dated Oct. 30, 2017.

*Primary Examiner* — Brian E Glessner
*Assistant Examiner* — Adam G Barlow
(74) *Attorney, Agent, or Firm* — Greer, Burns & Crain, Ltd.; Philip Petti; Pradip Sahu

(57) ABSTRACT

A panel for a shaftwall system includes a panel body with a core and at least one outer facing layer and an opposite backing surface. A score line is formed in the facing layer, defining two folded panel portions. The panel is folded along the score line to form a folded edge, and the folded panel portions are arranged so that the backing surfaces of the panel portions contact each other. A companion shaftwall building structure system is provided, including a plurality of the panels defining an enclosure, each panel being a ½-inch thick wallboard panel having a "V"-shaped score line defining a pair of panel portions, the score line forms a tapered edge of the folded panel. A plurality of brackets is provided, each bracket defining a panel track dimensioned for slidingly accommodating the folded panel and retaining the panel in place without the use of fasteners.

7 Claims, 7 Drawing Sheets

(51) Int. Cl.
*E04B 1/94* (2006.01)
*E04B 2/74* (2006.01)

(56) References Cited

U.S. PATENT DOCUMENTS 1,846,881 A * 2/1932 Lewis ..... E04C 2/405 52/631
2,149,882 A * 3/1939 MacMillan ..... B21D 53/74 228/142
2,505,789 A * 5/1950 Norquist ..... B27G 5/00 52/631
2,556,884 A * 6/1951 Muller ..... E04B 1/8409 181/290
2,776,231 A * 1/1957 Brown ..... F16L 59/023 138/141
2,991,824 A 7/1961 Loechl
3,117,902 A * 1/1964 Holzhelmer ..... F16L 59/22 156/217
3,251,382 A * 5/1966 Tatsch ..... F16L 9/003 138/151
3,312,585 A 4/1967 Hamme
3,469,361 A 9/1969 Winkowski
3,517,427 A * 6/1970 Nerem ..... B60P 3/32 29/897.2
3,539,425 A * 11/1970 Marburg ..... A47B 88/9416 156/247
3,557,840 A * 1/1971 Maybee ..... F16L 59/026 138/149
3,649,398 A * 3/1972 Keith ..... B29C 53/063 156/79
3,654,053 A * 4/1972 Toedter ..... A47B 96/202 428/56
3,702,044 A 11/1972 Balinski
3,731,449 A * 5/1973 Kephart, Jr. ..... E04C 2/205 52/631
3,909,995 A * 10/1975 Bainter ..... B62D 33/04 52/79.1
3,911,554 A * 10/1975 Ford ..... B23C 3/305 29/527.2
3,969,868 A * 7/1976 Bainter ..... B62D 29/04 428/201
4,073,177 A * 2/1978 Leroux ..... B21D 7/00 228/142
4,322,926 A * 4/1982 Wolflingseder ..... E06B 3/667 52/172
4,332,114 A * 6/1982 Goebel ..... F24F 13/20 182/47
4,428,898 A 1/1984 Buck et al.
4,704,837 A * 11/1987 Menchetti ..... E04B 2/723 52/273
5,210,990 A * 5/1993 Kirk, Jr. ..... E04B 1/26 52/631
5,232,762 A * 8/1993 Ruby ..... A47B 96/202 428/167
5,652,039 A * 7/1997 Tremain ..... B32B 3/04 428/121
5,724,784 A 3/1998 Menchetti
5,950,385 A 9/1999 Herren
6,148,573 A * 11/2000 Smythe, Jr. ..... B32B 29/00 52/255
6,619,007 B1 * 9/2003 Riesmeier ..... A47B 96/202 52/631
6,777,063 B2 * 8/2004 Born ..... B28B 11/003 428/167
8,141,316 B2 3/2012 Remin
8,236,114 B2 * 8/2012 Gangl ..... E04F 13/14 156/40
8,707,640 B2 * 4/2014 Wright ..... E04F 17/04 52/220.5
8,950,439 B2 * 2/2015 Dudley ..... E04C 2/328 138/149
9,840,050 B2 * 12/2017 Lanciaux ..... B29D 23/001
2010/0255243 A1 * 10/2010 Geeraert ..... E04F 13/141 428/61

* cited by examiner

SHAFTWALL SYSTEM USING FOLDED PANELS, AND PANEL

RELATED APPLICATION

This application is a Non-Provisional of, and claims priority under 35 USC 119 from, U.S. provisional application Ser. No. 62/385,613 filed Sep. 9, 2016, which is incorporated by reference.

BACKGROUND

The present invention relates generally to the construction of building shafts for enclosing elevators, stairways and the like, and more specifically, to an improved wallboard panel and an associated assembly for fabricating such shafts.

By code, shaft structures enclosing air return shafts, open shafts, stairway and elevator shafts and the like need to be fire retardant. Walls surrounding such shafts commonly separate the shafts from other rooms including corridors, restrooms and/or utility rooms. According to local building codes, such shafts typically have a fire rating of up to 2 hours to account for the fact that fires are often transmitted through such shafts from floor to floor of a building. In conventional modern building construction, such shafts are conventionally sheathed with gypsum wallboard of 1-inch thickness. It is customary to erect the shaftwalls from the surrounding rooms, without placing workers of equipment in the shafts themselves. Also, the shaftwall panels are held in place through a sliding relationship with surrounding metal studs or brackets. Conventionally, the panels are held in place in the brackets without fasteners. A suitable conventional shaftwall system is disclosed in U.S. Pat. No. 3,702,044 which is incorporated by reference. In the system disclosed in the '044 patent, the panels defining the shaftwall enclosure are 1-inch thick.

A manufacturing consideration of these panels is that standard wallboard is ½ inch thick, so the production line needs to be stopped and adjusted to manufacture the thicker 1-inch thick panels used in shaftwalls. Thus, a problem arises in scheduling production runs of special board, such as board which is twice as thick as conventional production panels. Accordingly, there is a need for an improved panel for shaftwall systems.

SUMMARY

The above-listed need is met or exceeded by the present panel for a shaftwall system incorporating folded panels, and an associated panel, which features a standard construction panel, typically having a ½-inch thickness, with a score line constructed and arranged so that upon folding the panel by moving two panel portions away from the score line, a panel of suitable thickness of approximately 1 inch is achieved. As such, panels for shaftwall systems need not be specially manufactured.

Accordingly, the present shaftwall panel is created from a standard ½ inch construction panel, preferably gypsum wallboard. The panel is divided by a score line into a pair of panel portions. In the preferred embodiment, the score line extends approximately half of the thickness of the panel. The panel is then "popped" or folded away from the score line, so that faces of the panel opposite the score line touch each other. In other words, the core fractures and allows the board to be folded back against itself. In the preferred embodiment, the panel portions are coextensive with each other. As a result, the folded panel portions create a single panel of double the standard thickness, which also is equivalent to the desired 1-inch thick panel configuration for shaftwalls. In the scoring process, angled or beveled edges are created that facilitate placement of the board into standard studs or brackets used to hold the panels without the use of fasteners.

More specifically, the present invention provides a panel for a shaftwall system, including a panel body with a core and at least one outer facing layer and a backing surface opposite the facing layer. A score line is formed in the facing layer, defining two folded panel portions. The panel being folded along the score line to form a folded edge, and the folded panel portions arranged so that the backing surfaces of the panel portions are in contact with each other.

In another embodiment, a shaftwall building structure system is provided, including a plurality of panels defining an enclosure, each panel being a ½-inch thick wallboard panel having a "V"-shaped score line defining a pair of panel portions, the score line extending approximately ½ of a thickness of the panel, with the panel portions folded back against each other away from the score line. The score line forms a tapered edge of the folded panel. A plurality of brackets is provided, each bracket defining a panel track dimensioned for slidingly accommodating the folded panel and retaining the panel in place without the use of fasteners. The brackets retain each panel on multiple edges to define a shaftwall enclosure.

DETAILED DESCRIPTION

Figure 1:
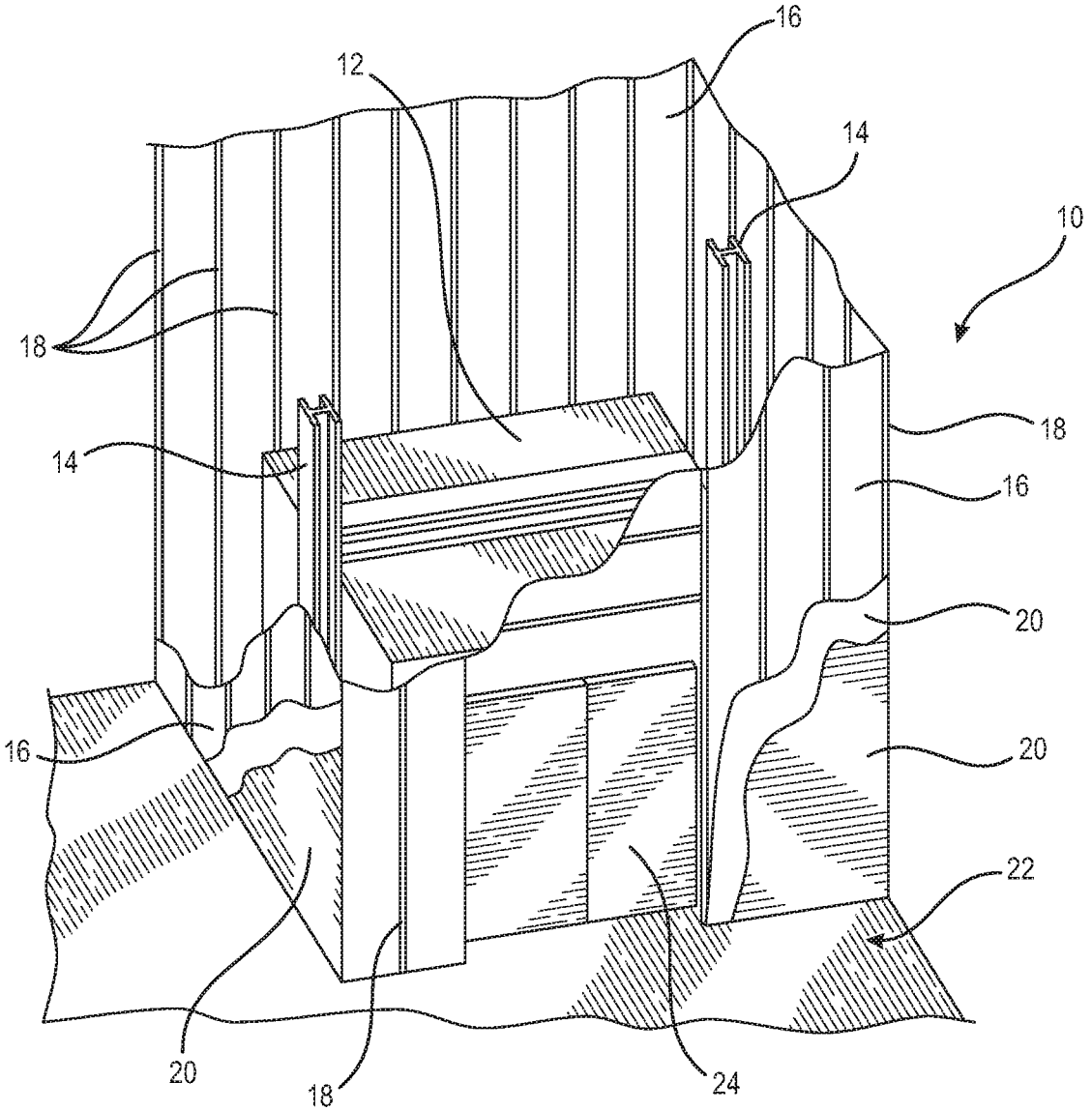
FIG. 1 (Prior Art)
FIG. 1 is a fragmentary perspective view of a prior art elevator shaft construction.

Referring now to FIG. 1, a conventional building shaft or shaftwall system is shown and generally designated 10. In this case, the shaft 10 is an elevator shaft, enclosing an elevator cab 12 riding in a track defined in part by vertical support beams 14. As is customary, the shaft 10 is defined by a plurality of panels 16 held in place by studs or brackets 18. The panels 16 are typically gypsum wallboard panels, having various types of facings or coatings depending on the application. As is well known in the art, suitable coatings or materials are designed to be more resistant to at least one of fire, moisture, impact damage or the like.

In assembling the shaft 10, which is performed from the respective floor or room side, and without the use of scaffolding, the installers typically secure the studs 18 to the building via fasteners such as screws or nails. Then, the panels 16 are slid into channels defined by the studs 18 and are secured in place. It is preferred that the panels 16 have a 1-inch thickness to comply with local fire codes, but are otherwise conventionally dimensioned, being provided in 4 foot by 8 foot sheets. However, the size of the panels 16 may vary to suit the situation. On a given floor, the installer progresses horizontally from one end of the shaft 10 to the next, successively installing a stud 18, then a panel 16, then another stud 18, etc. until the shaft 10 is enclosed on that floor. Once the shaft 10 is enclosed, additional interior finishing wallboard panels 20 are secured to a room side 22 of the shaft 10. Also, elevator access doors 24 are shown cut into the shaft 10 for providing elevator access.

Figure 2:
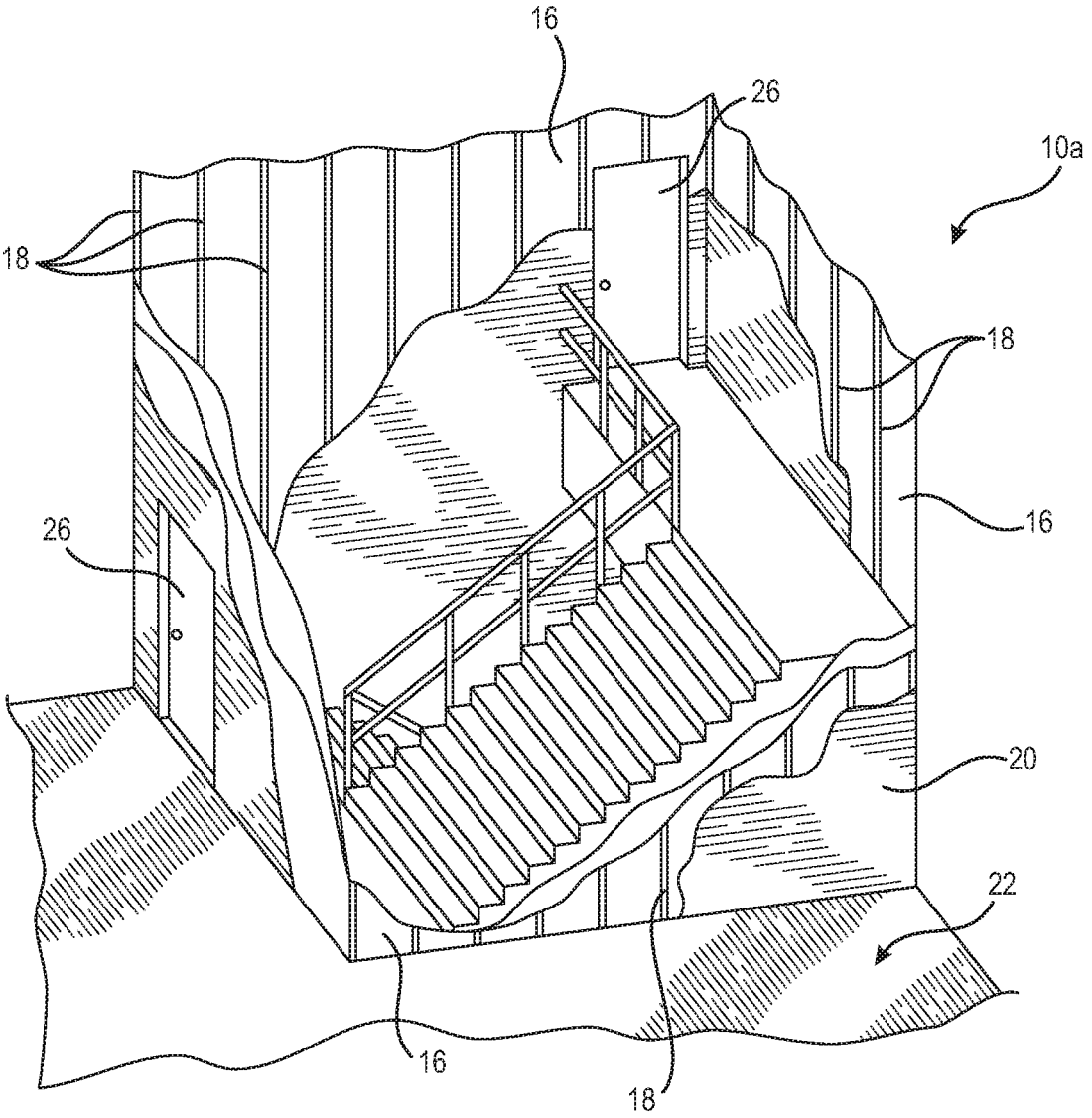
FIG. 2 (Prior Art)
FIG. 2 is a fragmentary perspective view of a prior art stairway shaft construction.

Referring now to FIG. 2, another conventional shaft, generally designated 10*a*, encloses a stairwell of the type seen in office buildings, apartments, schools, and other commercial buildings. Components shared with the shaft 10 are indicated with identical reference numbers. A main distinction between the shafts 10 and 10*a* is that the latter features stairway access doors 26 instead of the elevator access doors 22.

Figure 3:
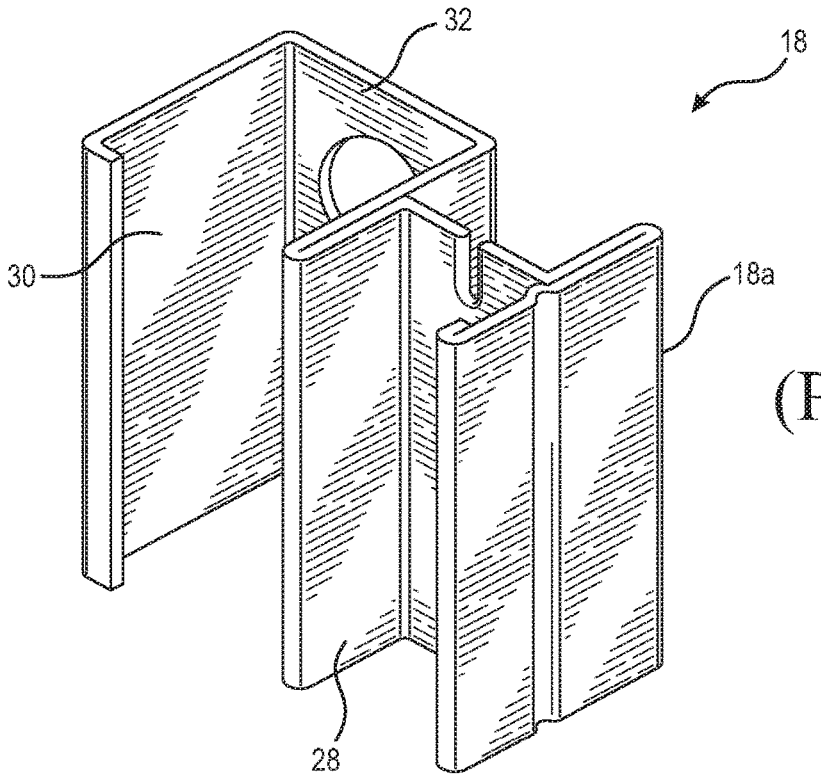
FIG. 3 (Prior Art)
FIG. 3 is a top perspective view of a sample prior art shaftwall H-stud bracket.
Figure 4:
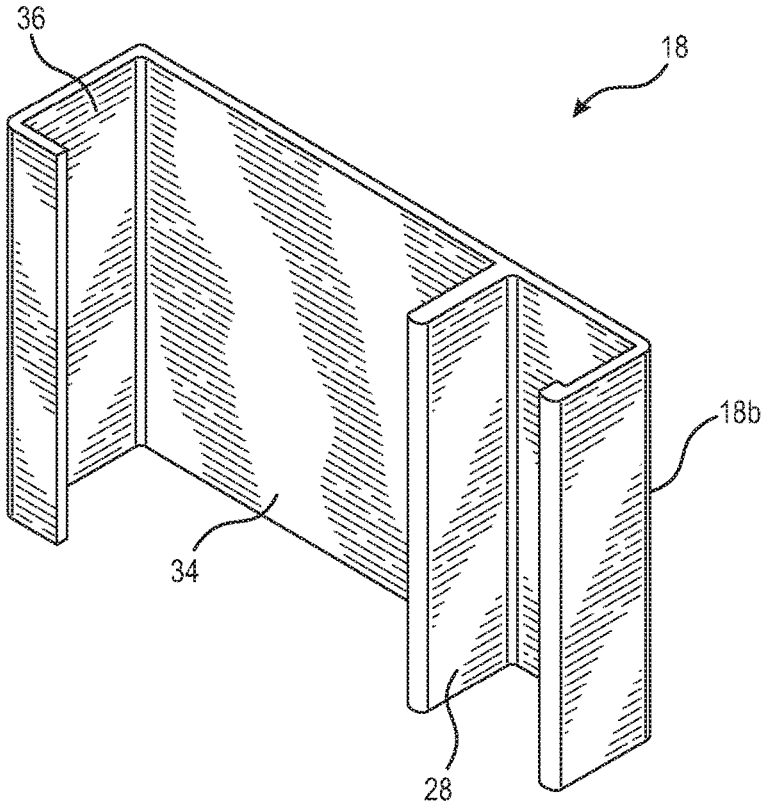
FIG. 4 (Prior Art)
FIG. 4 is a top perspective view of a sample prior art shaftwall E-stud bracket.

Referring now to FIGS. 3 and 4, representative conventional studs or brackets 18 are shown. In FIG. 3, the stud 18*a* is a so-called "H"-type, and defines a vertically projecting, generally "U"-shaped panel track 28. As is known in the art, the wallboard panels 16 are slidably engaged in the track 28 without the use of fasteners. Sidewalls 30 and 32 are used to secure the stud 18 to the adjacent building framework using threaded fasteners, powder-activated fasteners or the like. Similarly, in FIG. 4, the stud 18*b* is a so-called "E"-type, and also has a panel track 28. In this stud, 18*b*, sidewalls 34 and 36 are used to secure the stud to the adjacent building framework. While other materials are contemplated, the studs 18 are 20-25-gauge metal, preferably steel.

Figure 5:
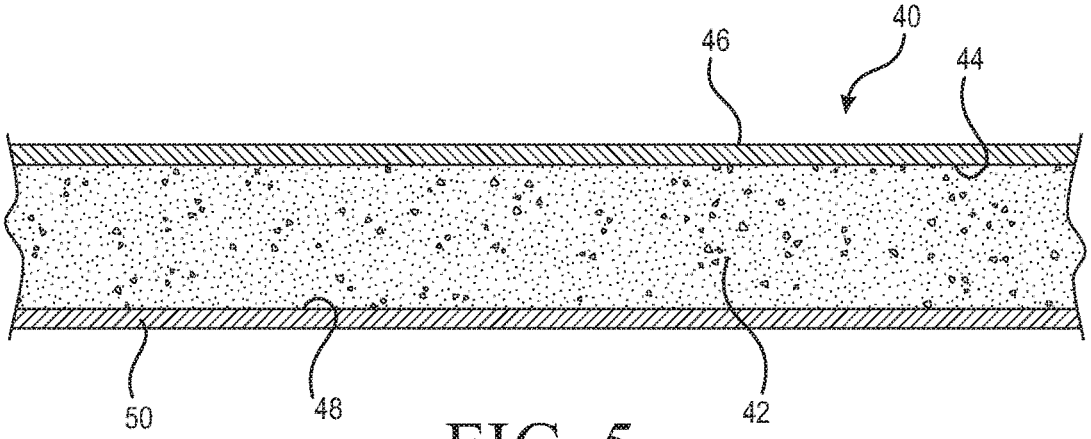
FIG. 5 is a fragmentary vertical cross-section of the present wallboard panel before being scored and folded.
Figure 6:
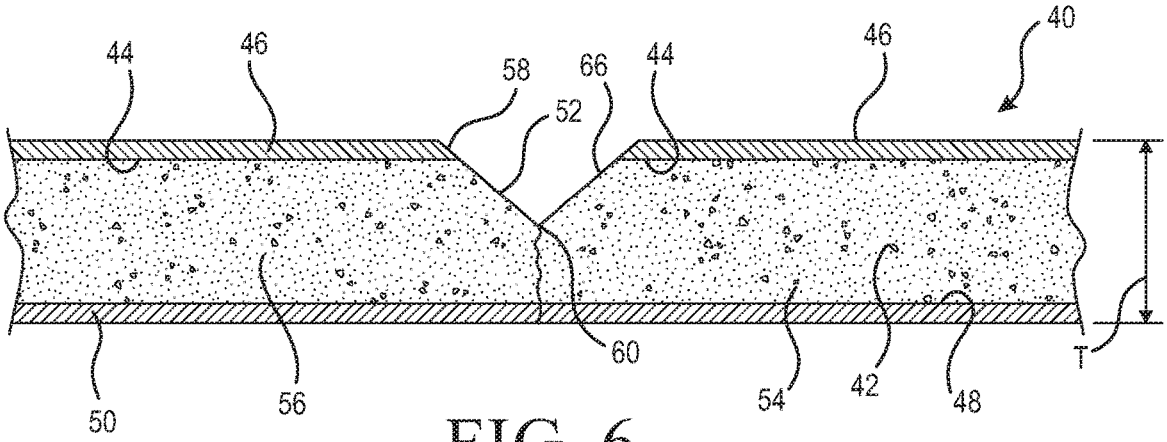
FIG. 6 is a fragmentary vertical cross-section of the present wallboard panel being scored.
Figure 7:
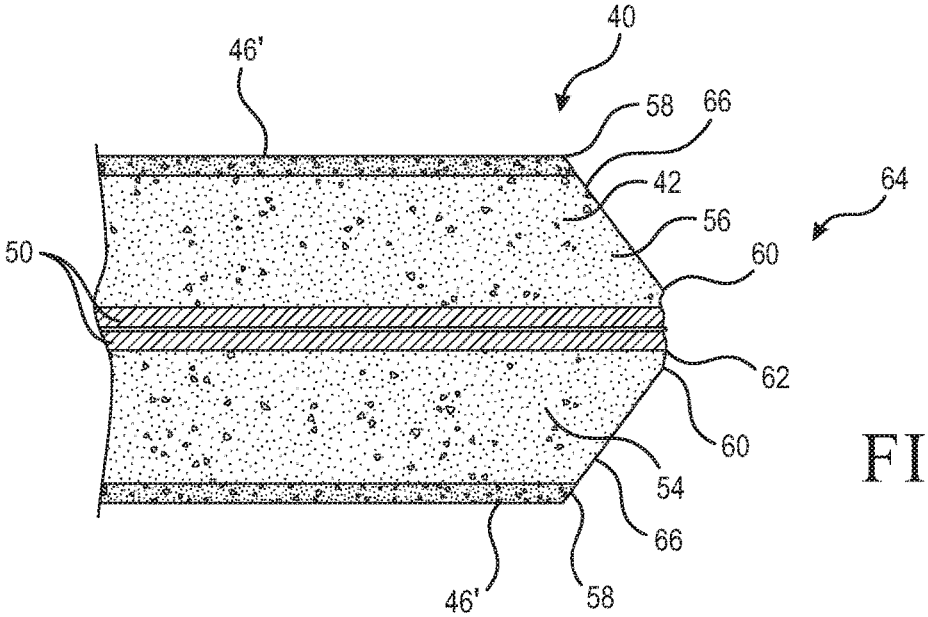
FIG. 7 is a fragmentary vertical cross-section of the present wallboard panel after scoring, being folded.

Referring now to FIGS. 5-7, the present panel for a shaftwall system such as designated 10 and 10*a* above is generally designated 40. The panel 40 includes a core 42, typically made of set gypsum and selected additives which are well known in the wallboard manufacturing art. However, the particular formulation of the core 42 is not considered critical to the present invention, and is contemplated as varying to suit the particular application. A first surface 44 of the core 42 is covered by an outer facing layer 46, commonly a durable paper layer with an ornamental facing. An opposite surface 48 of the core 42 is provided with a backing surface 50 opposite the facing layer 46. In the preferred embodiment, the backing surface 50 is lower grade craft paper, well known in the wallboard art. While in one embodiment, both the outer facing layer 46 and the backing surface 50 are made of paper, it is also contemplated that at least one of the surfaces is alternately made of a fiber mesh material 46' (FIG. 7). In such an embodiment, it is also contemplated that the backing surface 50 is made of low grade paper.

Referring now to FIG. 6, approximately midway along a width of the panel 40, a score line 52 is cut into the outer facing layer 46 and into the core 42 as well. Upon placement of the score line 52 in the panel 40, the panel becomes divided into two folded panel portions 54 and 56, preferably of relatively equal dimension, however asymmetrical panel portions are contemplated. It is especially preferred that the score line 52 extends approximately ½ a thickness "T" of the panel 40, which is preferably ½ inch, a standard wallboard panel configuration. However, other thicknesses are contemplated depending on the application. Also, the score line 52 defines a beveled shape having a general "V"-configuration, with a wide end 58 of the score line 52 located at the outer facing layer 46, and an opposite narrow end 60 ending approximately midway of the thickness "T." It will be appreciated that the present score line 52 is formed in the panel 40 during the manufacturing process, either before or after the panel is fully set or dried.

Figure 8:
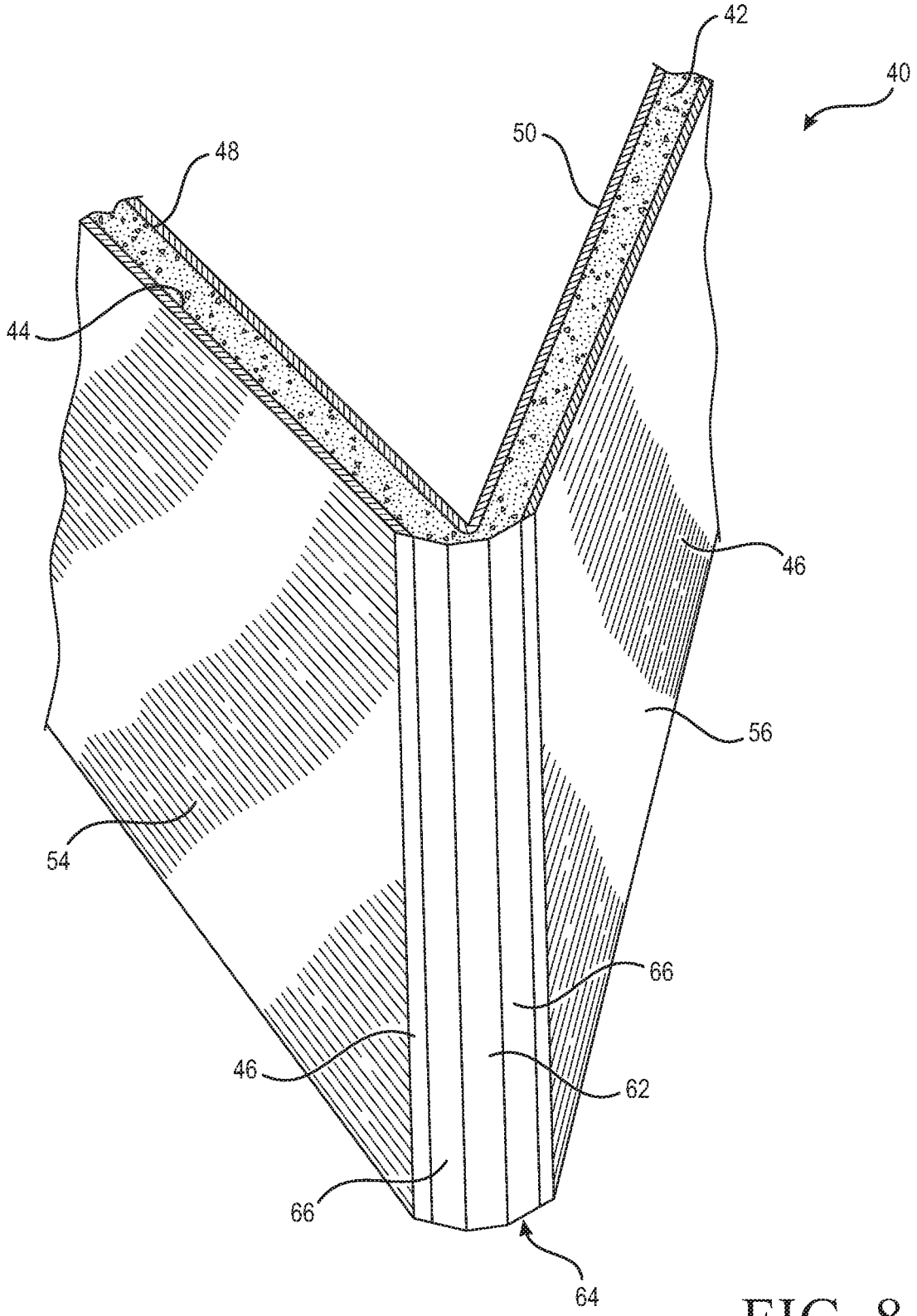
FIG. 8 is a top perspective view of a sample panel after scoring and in the process of being folded for placement into a bracket in a shaftwall.

Referring now to FIGS. 7 and 8, as is known in the art, once a gypsum wallboard panel is scored along one facing layer, it is relatively easy to fracture or "pop" the panel along the scored line through application of a force acting on the non-scored opposite facing layer. In the present panel 40 using this technique, the panel is popped by exerting an impact force on the backing surface 50. As a result, a fracture portion 62 is formed along the score line 52 that extends from the narrow end 60 of the score line 52 to the backing surface 50. After the popping process, the panel 40 is folded along the score line 52 to form an outer or folded edge 64, and the folded panel portions 54, 56 are arranged so that the backing surfaces 48 and the associated backing surfaces 50 are in contact with each other.

As seen in FIG. 7, the folded edge 64 forms a generally tapered or arrowhead shape, with the fracture portion 62 forming an outer portion of the folded edge or a tip of the arrow, and beveled edges 66 of the score line forming angled portions of the arrowhead which taper towards the fracture portion. As a result, the standard ½ inch thickness wallboard panel 40 is now formed into a narrower panel having a 1-inch thickness that slidingly engages the panel track 28 on the associated studs 18.

In the preferred embodiment, with the folded panel portions 54, 56 being relatively equal in dimension, it is contemplated that in the folded position shown in FIG. 7 that the backing surfaces 50 of the panel portions are in contact with each other about a total periphery of the respective portions.

Figure 9:
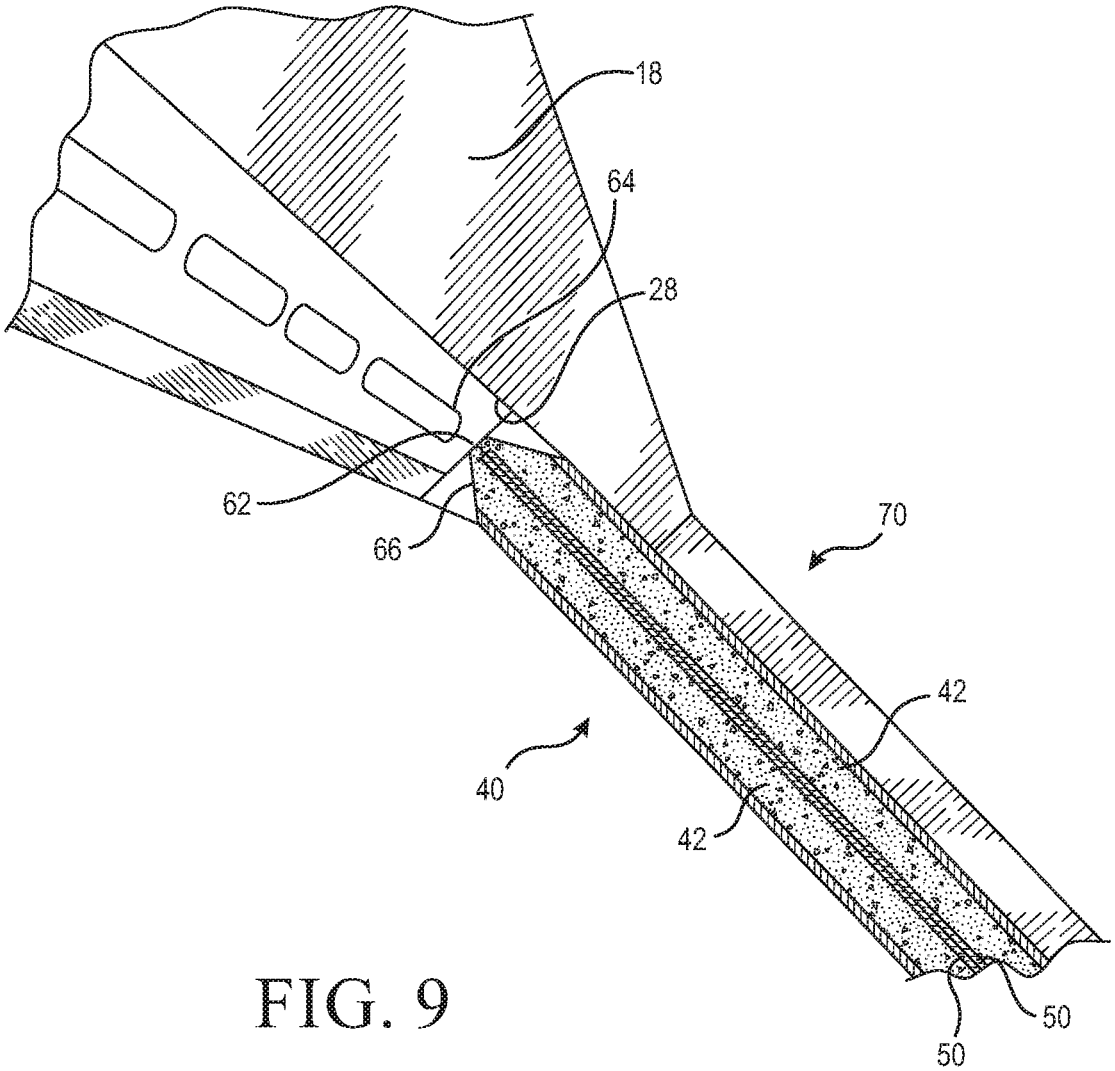
FIG. 9 is a top perspective view of the present shaftwall assembly showing the folded panel located within the shaftwall bracket without fasteners.
Figure 10:
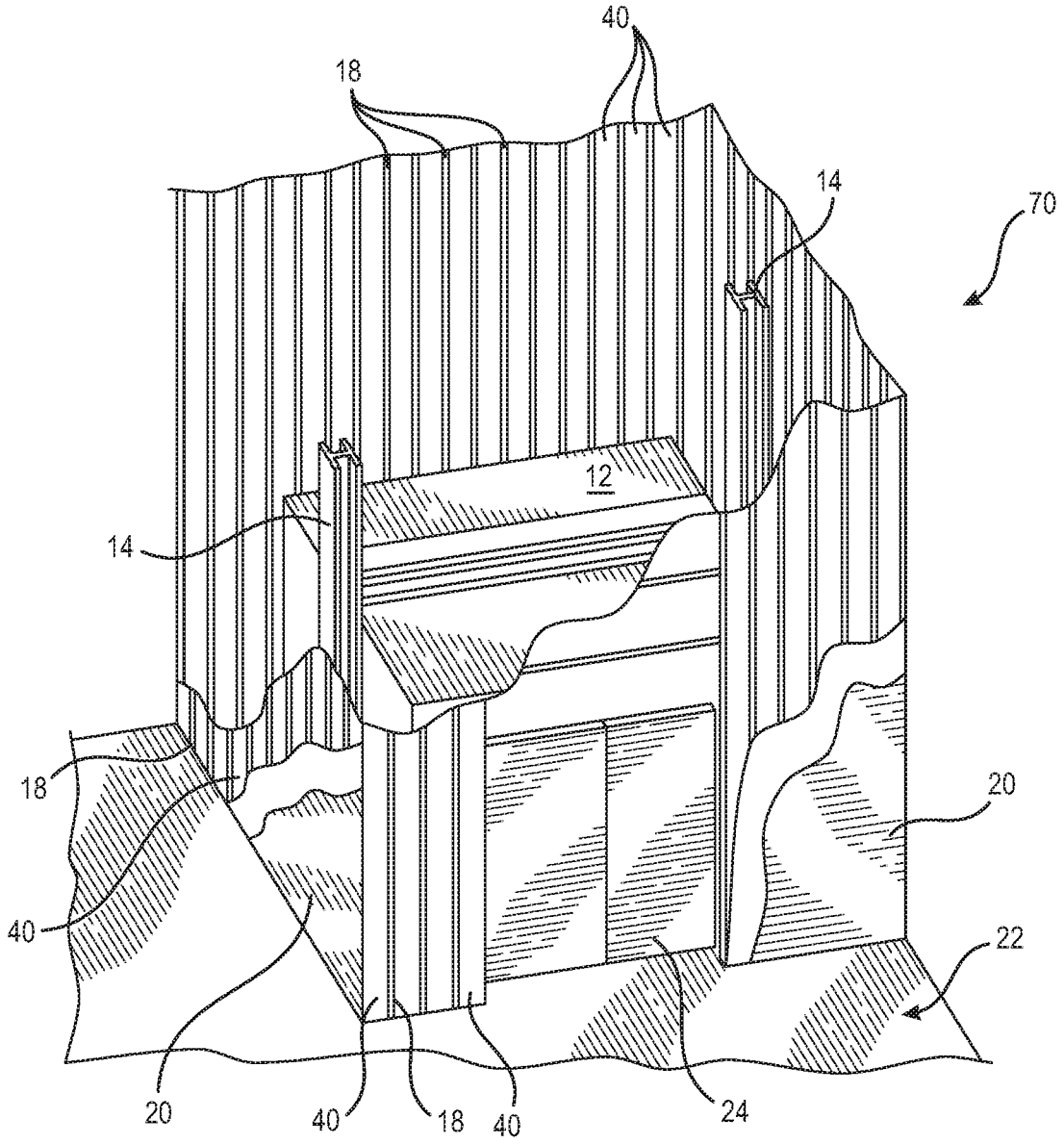
FIG. 10 is a fragmentary perspective view of an elevator shaft construction using the present folded panels.

Referring now to FIGS. 9 and 10, the panel 40 in the scored, popped and folded back configuration of FIG. 7 is slidingly engaged in the panel track 28 of a conventional stud 18 in the construction of the shaftwall 10, similar to that shown in FIGS. 1 and 2. However, instead of using conventional 1-inch thick panels, which are inconvenient to manufacture, the shaftwall is made of the panels 40. Thus, as seen in FIG. 10, a shaftwall system 70 is generally shown, being similar to the system 10 and having the required 2-hour fire rating, although using the ½ inch thick folded panels 40. In such a construction, obviously the panels 40 have a narrower width, and as such the spacing of the studs 18 is closer together than when conventional 1-inch thick panels are used. However, it is also contemplated that the panels 40 could initially be made longer, so that the shaft 70 would have an appearance similar to the shaftwall system 10. It has been found that an additional benefit of the present panel 40 is that the tapered, folded edge 64 is more easily located within the panel track 28 of the studs 18 than conventional 1-inch thick boards.

While a particular embodiment of the present shaftwall system using folded panels and associate panel has been described herein, it will be appreciated by those skilled in the art that changes and modifications may be made thereto without departing from the invention in its broader aspects and as set forth in the following claims.

The invention claimed is:

1. A panel for a shaftwall system, comprising:

a panel body with a core having opposing surfaces, a first one of said opposing surfaces being covered by an outer facing layer, and a second one of said opposing surfaces being covered by a backing surface layer, wherein said outer facing layer and said backing surface layer are each made with a paper material or a glass mat material;

a score line formed in said outer facing layer and said core, defining two folded panel portions, said score line being spaced from said backing surface layer and including opposing edges that meet at a common end, wherein a portion of said core at said score line is not covered by said outer facing layer and said core includes a fracture portion extending between said score line and said backing surface layer;

said panel body configured to be folded at said common end such that said fracture portion of said core fractures and enables said panel body to move between an unfolded position and a folded position, wherein in said folded position, said panel body forms a folded edge in which said panel portions are arranged so that said backing surface layers of said panel portions are in contact with each other.

2. The panel of claim 1, wherein said score line defines a beveled shape having a general "V"-configuration, with a wide end and an opposite narrow end.

3. The panel of claim 2, wherein said panel body has a thickness, and said common end of said score line is at a point that is one half of said thickness of said panel.

4. The panel of claim 3, wherein a region of said panel between a tip of said score line and said backing surface layer forms an outer portion of said folded edge.

5. The panel of claim 1, wherein said folded edge defines a generally tapered shape when viewed from the side.

6. The panel of claim 1, wherein said backing surface layers of said panel portions are in contact with each other about a total periphery of said respective portions.

7. The panel of claim 1, wherein said panel body and said facing and backing surface layers have a combined thickness of 0.5 inches.

* * * * *